US005957206A

United States Patent [19]

Patel

[11] Patent Number: 5,957,206

[45] Date of Patent: Sep. 28, 1999

[54] PLUG FOR OPERATING A DOWNHOLE DEVICE USING TUBING PRESSURE

[75] Inventor: Dinesh R. Patel, Sugar Land, Tex.

[73] Assignee: Schlumberger Technology Corporation, Sugar Land, Tex.

[21] Appl. No.: 09/198,437

[22] Filed: Nov. 24, 1998

[51] Int. Cl.[6] ..... E21B 34/10

[52] U.S. Cl. ..... 166/317; 166/321; 166/334.2

[58] Field of Search ..... 166/317, 319, 166/321, 332.2, 332.3, 334.2, 332.6, 332.4

[56] References Cited

U.S. PATENT DOCUMENTS

| | | | |
|---|---|---|---|
| 2,999,545 | 9/1961 | Bigelow | 166/153 |
| 3,912,008 | 10/1975 | Crowe | 166/212 |
| 4,586,569 | 5/1986 | Hyde | 166/317 |
| 5,012,867 | 5/1991 | Kilgore | 166/188 |
| 5,655,607 | 8/1997 | Mellemstrand et al. | 166/386 |

FOREIGN PATENT DOCUMENTS

| | | |
|---|---|---|
| 0823537 | 2/1998 | European Pat. Off. . |
| 688727 | 3/1953 | United Kingdom . |

*Primary Examiner*—William Neuder
*Assistant Examiner*—John Kreck
*Attorney, Agent, or Firm*—John Ryberg; Jeffrey E. Griffin

[57] ABSTRACT

A plug for actuating a movable member of a device in a wellbore includes a housing adapted to be lowered into the wellbore and a seal member mounted on the housing. The seal member is arranged to engage the movable member such that a pressure applied to the first end of the housing moves the housing and the movable member. A chamber is provided in the housing, and a pressure responsive member at an inlet end of the chamber permits fluid communication with the chamber when the pressure applied to the first end of the housing reaches a predetermined pressure.

17 Claims, 2 Drawing Sheets

PLUG FOR OPERATING A DOWNHOLE DEVICE USING TUBING PRESSURE

BACKGROUND OF THE INVENTION

1. Technical Field

The invention relates generally to wellbore operations. More particularly, the invention relates to a method and an apparatus for actuating a movable member of a downhole device.

2. Background Art

Downhole devices that have slidable members and that are operable by actuating the slidable members are routinely employed for various wellbore operations. Examples of such downhole devices include ball, flapper, and sleeve valves. Typically, a shifting tool is run into the wellbore to engage the slidable member. Then, force is applied to the shifting tool to actuate the slidable member, e.g., by moving the slidable member along an axial axis of the wellbore. The shifting tool is typically lowered into the wellbore on the end of a coiled tubing or pipe. The stiffness of the coiled tubing makes it possible to apply weight to the shifting tool to actuate the slidable member. However, because the weight that can be applied to the coiled tubing is limited, the shifting tool may not have the necessary force required to move the slidable member, e.g., when debris is lodged in the path of the slidable member. In addition, mobilizing a coiled tubing is very expensive, and retrieving the coiled tubing after operating the downhole device will require either stripping the tubing out or killing the well, both of which are very costly operations. Therefore, it is desirable to have a reliable means of providing adequate force to actuate a slidable member of a downhole device. It is also desirable that this means for providing adequate force is cost-effective.

SUMMARY OF THE INVENTION

In one aspect, a plug for actuating a movable member of a device in a wellbore comprises a housing adapted to be lowered into the wellbore and a seal mounted on the housing. The seal member is arranged to engage the movable member such that a pressure applied to a first end of the housing moves the housing and the movable member.

In another aspect, a plug for actuating a movable member of a device in a wellbore comprises a housing adapted to be lowered into the wellbore and a seal member mounted on the housing. The seal member is arranged to engage the movable member such that a pressure applied to a first end of the housing moves the housing and the movable member. A chamber is provided in the housing and a pressure responsive member is disposed at an inlet end of the chamber. The pressure responsive member is arranged to permit fluid communication with the chamber when the pressure applied to the first end of the housing reaches a predetermined pressure.

In yet another aspect, a method for actuating a movable member of a device in a wellbore comprises providing a plug having a housing and a seal member mounted on the housing; lowering the plug to the movable member such that the seal member engages the movable member; and applying sufficient pressure to the housing to move the plug and the movable member.

Other features and advantages of the invention will be apparent from the following description and the appended claims.

DETAILED DESCRIPTION

Figure 1:
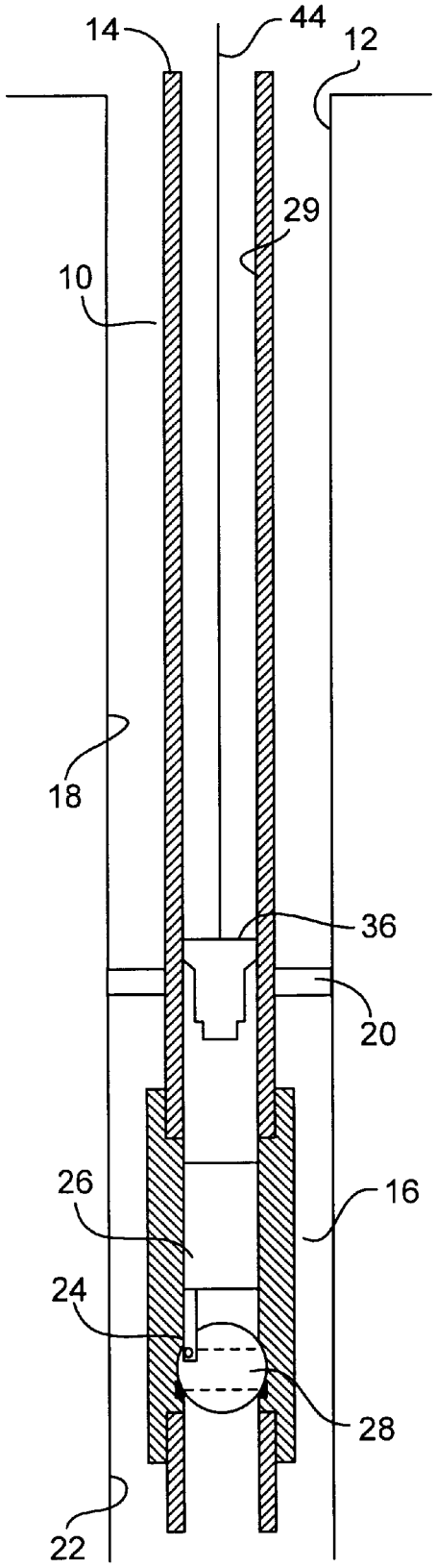
FIG. 1 shows a downhole valve suspended in a wellbore.

Referring to the drawings wherein like characters are used for like parts throughout the several views, FIG. 1 depicts a downhole tool 10 that is suspended in a wellbore 12. The downhole tool 10 includes a tubing 14 and a valve assembly 16. An annular space 18 is defined between the wellbore 12 and the downhole tool 10, and a packer 20 isolates a lower section 22 of the wellbore 12 from the annular space 18. While the wellbore 12 is shown as a vertical wellbore, it should be clear that the invention is equally applicable to a horizontal wellbore or an inclined wellbore.

Figure 2:
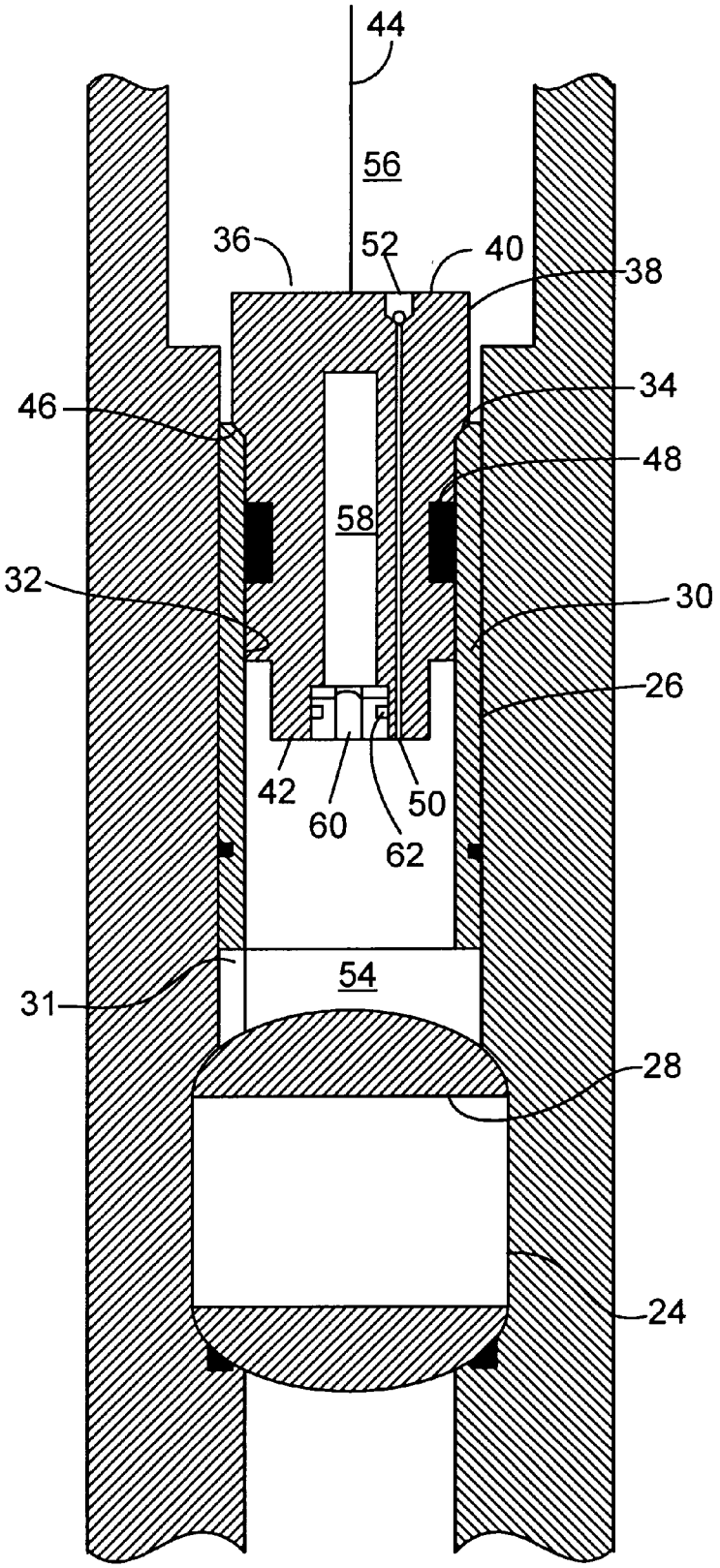
FIG. 2 is an enlarged cross-sectional view of the downhole valve shown in FIG. 1.

Referring to FIGS. 1 and 2, the valve assembly 16 comprises a ball valve 24 and a valve operator 26. The ball valve 24 has a bore 28. The valve operator 26 has a mandrel 30 and an arm 31 that is connected to the ball valve 24. The valve operator 26 can be moved downwardly to rotate the ball valve 24 to the open position, wherein the bore 28 is aligned with the tubing bore 29 and fluid communication between the lower section 22 of the wellbore and the tubing bore 29 is permitted. The valve operator 26 can be moved upwardly to rotate the ball valve 24 to the closed position, wherein the bore 28 is out of alignment with the tubing bore 29 and fluid communication between the lower section 22 of the wellbore and the tubing bore 29 is prevented.

The mandrel 30 includes a smooth inner diameter seal bore 32 and a plug seat 34 with a no-go profile. A plug 36 is received in the mandrel 30. The plug 36 includes a housing 38 having a first end 40 and a second end 42. The first end 40 is coupled to a slick line 44 so as to allow the plug 36 to be lowered into the mandrel 30 on the end of the slick line 44. Alternatively, the plug 36 may be run into the mandrel 30 on the end of a cable or coiled tubing. The housing 38 has a shoulder 46 that is adapted to seat on the plug seat 34. The no-go profile of the plug seat 34 prevents the shoulder 46 from moving past the plug seat 34. Seals 48 are mounted on the outer diameter of the housing 38. The seals 48 are arranged to enter the seal bore 32 to create a pressure seal between the housing 38 and the mandrel 30 when the housing 38 is seated on the plug seat 34.

A flow passage 50 is provided in the housing 38. The flow passage 50 extends from the first end 40 to the second end 42 of the housing. A check valve 52 is disposed in the flow passage 50. The check valve 52 permits fluid to flow from a space 54 below the plug to a space 56 above the plug but prevents fluid from flowing from the space 56 to the space 54. When the ball valve 24 is in the closed position, and while the plug 36 is being lowered into the mandrel 30, the check valve 52 allows fluid to flow from the space 54 to the space 56 so that the seals 48 can enter the seal bore 32 and create the desired pressure seal between the housing 38 and the mandrel 30.

An air chamber 58 is provided in the housing 38. The air chamber 58 may communicate with the space 54 through a port 60 in the housing. A pressure responsive member, e.g., rupture disc 62, is provided to seal off the port 60. The burst pressure of the rupture disc 62 is set higher than the fluid column hydrostatic pressure in the wellbore 12 to prevent any premature bursting of the rupture disc while the plug 36 is being lowered into the mandrel 30. The rupture disc 62 will burst when a pressure applied to the tubing bore 29 above the plug 36 reaches the burst pressure of the rupture disc. When the rupture disc 62 bursts, fluid communication between the air chamber 58 and the space 54 will occur.

In operation, the plug 36 is lowered into the mandrel 30 until the shoulder 46 of the housing 38 is landed on the plug seat 34 and the seals 48 engage the seal bore 32. At this point, the space 54 between the plug 36 and the closed ball valve 24 now becomes a closed chamber. Once the plug 36 engages the mandrel 30, pressure is applied to the first end 40 of the plug 36 by pumping fluid down the tubing bore 29. The pressure in the tubing 14 applies a downward force on the plug 36, which tends to move the plug 36 downwardly. Because the seals 48 effectively couple the plug 36 to the valve operator 26, the downward force applied to the plug 36 also tends to move the valve operator 26 downwardly. However, because the closed chamber 54 is filled with an incompressible fluid, this downward force will not move the plug 36 and the valve operator 26 downwardly.

In order to allow the plug 36 and the valve operator 26 to move down, fluid must be displaced from the closed chamber 54. Once the closed ball valve 24 begins to open, the remaining fluid in the closed chamber 54 can drain through the bore 28 of the ball valve 24. To displace fluid from the closed chamber 54 while the ball valve 24 is closed, pressure is applied to the tubing bore 29 above the plug 36. When the applied pressure in the tubing bore 29 reaches the burst pressure of the rupture disc 62, the rupture disc 62 bursts and permits fluid to flow into the air chamber 58. The air chamber 58 has a volume larger than the volume of fluid to be displaced from the closed chamber 54 before the ball valve 24 begins to open.

Once the fluid is displaced into the air chamber 58, the downward force acting on the plug 36 and the valve operator 26 moves the plug 36 and the valve operator 26 downwardly. As the valve operator 26 moves downwardly, the arm 31 rotates the ball valve 24 to the open position, allowing fluid communication between the tubing bore 29 and the lower section 22 of the wellbore 12. The plug 36 may be retrieved from the mandrel 30 when the valve 24 is filly open. Although, the plug 36 is illustrated as opening the ball valve 24, it should be clear that the plug 36 may also be used to close a ball valve if the valve operator is connected to the ball valve in such a way that a downward movement of the valve operator rotates the ball valve to the closed position.

The invention provides advantages. First, the invention provides a high operating force for actuating the valve operator. This operating force is a product of the pressure in the tubing 14 and the cross-sectional area over which the pressure acts and can be increased by increasing the pressure in the tubing, where the maximum pressure in the tubing 14 is only limited by the maximum pressure that the tubing can withstand without failing. The cross-sectional area over which the pressure in the tubing 14 acts is the cross-sectional area of the tubing bore 29 less the cross-sectional area of the line, cable, or pipe used to deploy the plug 36. Therefore, the operating force for actuating the valve operator can be further maximized by keeping the diameter of the line, cable, or pipe used to deploy the plug 36 to a minimum so that the cross-sectional area over which the tubing pressure acts is effectively the same as the cross-sectional area of the tubing bore.

Secondly, the plug may be run on a slick line or cable to open the valve. A slick line run for opening a valve is much faster compared to a coiled tubing or pipe run to open the valve. Deploying the plug on a slick line or cable eliminates the need for expensive equipment and allows the plug to be retrieved without a need for stripping the line or cable or killing the well. In addition, a slick line or cable unit is easier and safer to operate compared to a coiled tubing unit or stripping the coiled tubing out with wellhead pressure.

While the invention has been described with respect to a limited number of embodiments, those skilled in the art will appreciate numerous variations therefrom without departing from the spirit and scope of the invention. For example, the plug can be employed in operating flapper valves, sleeve valves, or other downhole devices requiring axial mechanical motion to operate them. In situations where a closed chamber is not defined between the device to be actuated and the plug, such as when the plug is used to operate a sleeve valve, the chamber in the plug housing may be not be necessary.

What is claimed is:

1. A plug for actuating a movable member of a device in a wellbore, comprising:

a housing adapted to be lowered into the wellbore;

a seal member mounted on the housing to engage the movable member, wherein a closed chamber is formed between the housing and the device when the seal member engages the movable member;

an internal chamber provided in the housing; and a pressure responsive member disposed at an inlet end of the chamber to allow fluid communication between the closed chamber and the internal chamber when a pressure applied to a first end of the housing reaches a predetermined pressure, wherein the pressure applied to the first end of the housing moves the housing and the movable member.

2. The plug of claim 1, wherein the first end is adapted to be coupled to a slick line.

3. The plug of claim 1, further comprising a flow passage in the housing and a valve disposed in the flow passage, the flow passage and the valve permitting fluid to flow from a space adjacent a second end of the housing to a space adjacent the first end of the housing.

4. A plug for actuating a movable member of a device in a wellbore, comprising:

a housing adapted to be lowered into a wellbore;

a seal member mounted on the housing, the seal member being arranged to engage the movable member such that a pressure applied to a first end of the housing moves the housing and the movable member;

a chamber provided in the housing; and a pressure responsive member disposed at an inlet end of the chamber, the pressure responsive member being arranged to permit fluid communication with the chamber when the pressure applied to the first end of the housing reaches a predetermined pressure.

5. An apparatus for operating a device in a wellbore, comprising:

a movable member coupled to actuate the device; and a plug for actuating the movable member, the plug comprising:

a housing adapted to be lowered into the wellbore, the housing being provided with an internal chamber;

a seal member mounted on the housing, the seal member being arranged to engage the movable member such that a pressure applied to a first end of the housing moves the housing and the movable member; and a pressure responsive member disposed at an inlet end of the internal chamber to allow fluid communication with the internal chamber when the pressure applied to the first end of the housing reaches a predetermined pressure.

6. The apparatus of claim 5, wherein the movable member comprises a body having a bore and a plug seat and an arm coupled to the device.

7. The apparatus of claim 6, wherein the housing is slidably receivable in the bore and adapted to be supported on the plug seat, and wherein the seal member engages the bore when the housing is supported on the plug seat.

8. The apparatus of claim 7, wherein the plug comprises a flow passage extending from the first end of the housing to a second end of the housing and a check valve in the flow passage, the check valve being arranged to permit fluid to flow from a space adjacent the second end of the housing, through the flow passage, into a space adjacent the first end of the housing.

9. An apparatus for use in a wellbore having a tubular member suspended therein, comprising:

a valve;

a movable member coupled to actuate the valve; and a plug for actuating the movable member, the plug comprising a housing having an internal chamber and a seal member mounted on the housing, the seal member for engaging the movable member such that a pressure applied to a first end of the housing moves the plug and the movable member to actuate the valve, the plug further comprising a pressure responsive member for allowing fluid communication with the internal chamber when the pressure applied to the first end of the housing reaches a predetermined pressure.

10. The apparatus of claim 9, wherein fluid pumped through a bore of the tubular member applies the pressure to the first end of the housing.

11. The apparatus of claim 10, wherein the valve includes a ball valve having an open position and a closed position.

12. The apparatus of claim 11, wherein the movable member comprises a body having a bore and a plug seat and an arm coupled to rotate the ball valve from the closed position to the open position.

13. The apparatus of claim 12, wherein the housing is slidably receivable in the bore and adapted to be supported on the plug seat, and wherein the seal member engages the bore when the housing is supported on the plug seat.

14. The apparatus of claim 13, wherein a closed chamber is defined between the ball valve and the plug when the seal member engages the bore and the ball valve is in the closed position.

15. The apparatus of claim 13, wherein the plug further comprises a flow passage in the housing and a valve means disposed in the flow passage, the valve means being arranged to permit fluid to flow from a space between the ball valve and the plug to a space above the first end of the housing.

16. The apparatus of claim 9, wherein the first end of the housing is adapted to be coupled to a slick line.

17. A method for actuating a movable member of a device in a wellbore, comprising:

providing a plug comprising a housing, an internal chamber in the housing, a pressure responsive member at an inlet end of the internal chamber, and a seal member mounted on the housing;

lowering the plug to the movable member such that the seal member engages the movable member; and applying sufficient pressure to the housing to move the plug and the movable member.

* * * * *